United States Patent [19]

Trotter et al.

[11] 4,184,457

[45] Jan. 22, 1980

[54] WATER FLOW RESPONSIVE CONTROL FOR A LIQUID HEATER

[76] Inventors: Albin Trotter; Ursus Trotter, both of Karen 2908, Lac Cruces, N. Mex. 88001

[21] Appl. No.: 890,787

[22] Filed: Mar. 27, 1978

[51] Int. Cl.[2] ..... F22B 35/00; F23N 1/08

[52] U.S. Cl. ..... 122/448 R; 236/23

[58] Field of Search ..... 122/448 R, 448 S; 126/351; 236/23, 25

[56] References Cited

U.S. PATENT DOCUMENTS

| | | | |
|---|---|---|---|
| 2,258,590 | 10/1941 | Merten | 236/25 |
| 3,627,202 | 12/1971 | Meier | 236/25 |
| 3,722,523 | 3/1973 | Kawabata et al. | 126/351 |
| 3,917,162 | 11/1975 | Trotter et al. | 236/23 |

FOREIGN PATENT DOCUMENTS

| | | | |
|---|---|---|---|
| 1100421 | 1/1968 | United Kingdom | 122/448 |

*Primary Examiner*—Kenneth W. Sprague
*Attorney, Agent, or Firm*—Brisebois & Kruger

[57] ABSTRACT

A venturi operated water flow responsive valve controls the flow of gas to the burner of an instantaneous water heater by controlling the flow of gas between chambers of a main control valve. The venturi operated valve is of the diaphragm type and the gas flow is controlled as a function of water flow rate.

2 Claims, 1 Drawing Figure

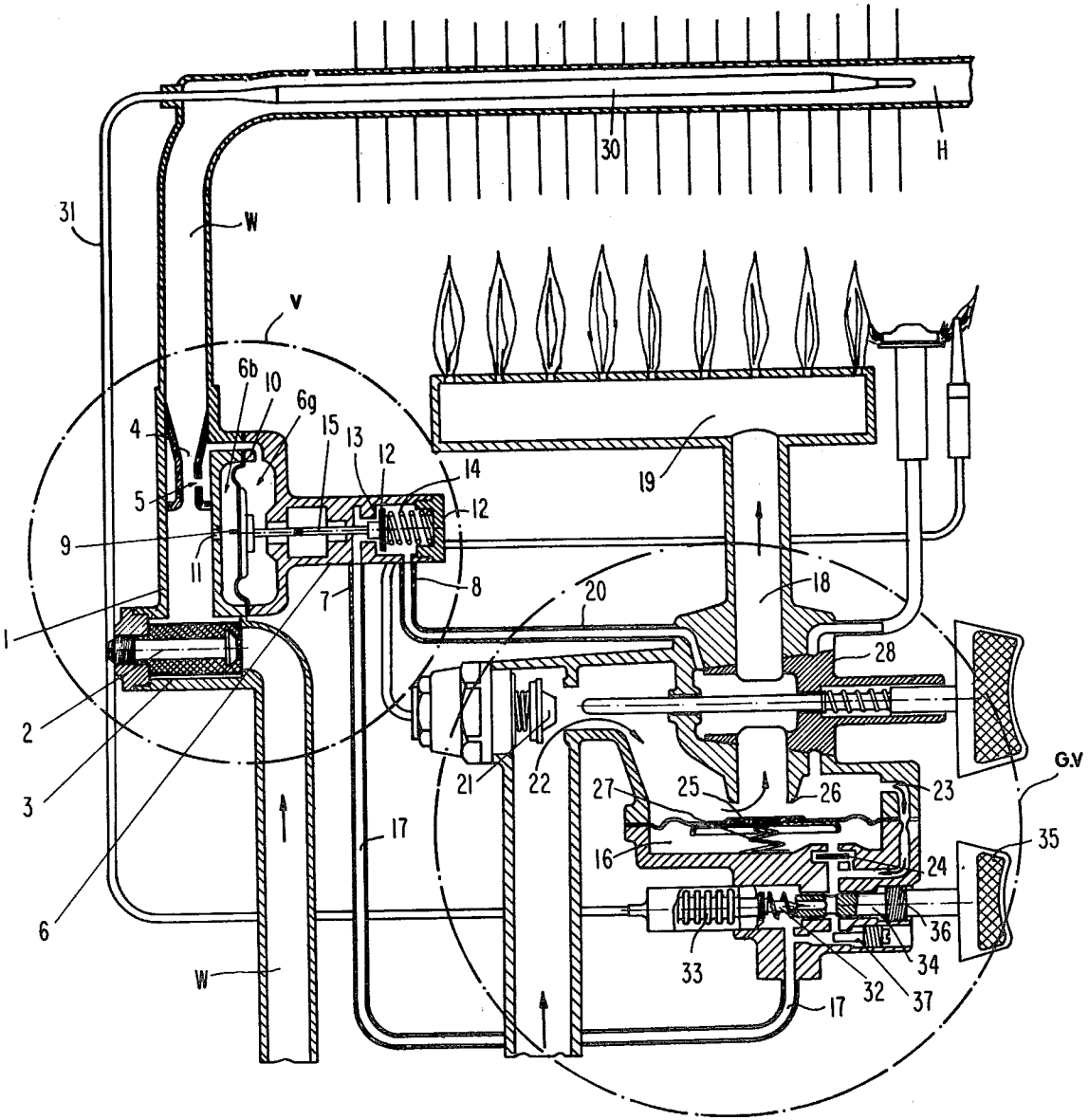
H
30
31
W
V
4
5
6b
10
6g
15
13
12
14
12
8
9
11
1
2
3
6
7
17
W
19
18
20
21
22
28
23
24
25
26
27
16
33
32
17
34
36
37
35
GV

WATER FLOW RESPONSIVE CONTROL FOR A LIQUID HEATER

SUMMARY OF THE INVENTION

The object of the present invention is to improve the control system for the diaphragm valve controlling the gas flow in instantaneous water heaters as disclosed in U.S. Pat. No. 3,917,162, dated Nov. 4, 1975.

The control system for the diaphragm gas valve disclosed in U.S. Pat. No. 3,917,162 represents a substantial improvement over the system disclosed in U.S. Pat. No. 3,806,026, dated Apr. 23, 1974.

Practical use has shown that despite the fact that the system disclosed in U.S. Pat. No. 3,917,162 is sufficiently efficient to serve the purposes of providing a constant "modulation" of the burner flame, a progressive lighting of the burner and the instantaneous cut-off of the water heater burner, the additional modifications and improvements according to the present invention provide a simple system which operates more satisfactorily and costs less to manufacture.

Fundamentally, the improved device that is the object of the present invention comprises a novel assembly of water passages of the "venturi" type operating a primary gas valve that in turn controls the opening and closing of a diaphragm type main gas valve, which can be regulated through its entire opening range by means of the thermostatic control system disclosed in U.S. Pat. No. 3,917,162.

BRIEF DESCRIPTION OF THE DRAWING

The drawing is a side elevation of the system, with the primary gas valve, the main gas valve, and the primary control valve of this invention shown in section.

DETAILED DESCRIPTION OF PREFERRED EMBODIMENT

As illustrated in the FIGURE, at the left side of the drawing, in the cold water duct W there is inserted a housing (shown inside the circle V) comprising the improved primary control valve of the invention.

Inside the inlet end of the hollow body there is a water flow restrictor 2 that can be manually regulated or adjusted from the outside of the device. The restrictor 2 is enclosed in a water filter 3 which filters the water flowing through hollow body 1.

Inside the outlet end of the hollow body is a venturi 4 having a suction passage 5 located in the throat area of the venturi.

Adjacent to the middle portion of the hollow body 1, and forming a right angle relative to said body there is a hollow case 6 housing a diaphragm water/gas valve provided with respective gas inlet and outlet passages 7, 8.

The base portion of the hollow case 6 is separated into two chambers **6*a* and 6*b* by a resilient diaphragm 9**.

The upper chamber **6*a* (at the right side of the diaphragm 9) is connected to the suction passage 5 of the venturi throat by a passage 10, and the lower chamber 6*b* is connected to the inlet side of the venturi by a passage 11**.

The right side of the hollow case 6 is provided with the gas inlet passage 7 and the gas outlet passage 8. Passages 7 and 8 are separated by a closure disc 12 biased against a valve seat 13 by a spring 14.

The closure disc 12 is affixed to the end of a rod 15 that is connected to the resilient diaphragm 9. A suitable seal (not shown) between rod 15 and housing 6 prevents water from chamber **6*a* from entering the region of the gas system at the right side of case 6**.

The inlet gas passage 7 is connected to the lower chamber 16 of a diaphragm type main gas valve (GV) by a duct 17, and the outlet gas passage 8 is connected to the gas passage 18 of the burner 19 via the cone valve 28 by a duct 20.

The primary control valve (V) operates in response to fluctuations of the water flowing through the water heater H, said fluctuations being produced at will by the user or being caused by the changes in the pressure of the main water pipe line.

The main gas valve (GV) is constructed and operates as disclosed in the U.S. Pat. No. 3,917,162, and its operation will be described subsequently.

In operation, the primary gas control valve V of the invention operates as follows.

The combustible gas enters the main valve (GV) through a pilot flame operated safety valve 21, filling the upper chamber 22 and passing through the passage 23 to the lower chamber 16 and to the duct 17 located under the "ignition retarding valve" 24.

When the flow of water through the water heater is interrupted, the pressure inside the chambers **6*a* and 6*b* of the primary valve (V) is equalized and the spring 14 seats the closure disc 12 on the valve seat orifice 13 thus preventing the flow of gas from the duct 17 through inlet 7 to the outlet 8, duct 20, and the main gas passage 18. When the valve seat orifice 13 is closed the pressure inside the upper chamber 22 and the lower chamber 16 of the main gas valve (GV) is equalized, and the resilient diaphragm 25 is seated against the gas outlet 26 by the action of the spring 27, thus preventing the main flow of gas to the burner 19**.

When a predetermined stream of water flows through the hollow body 1 of the primary valve (V) the pressure in the chambers **6*a* is reduced below the pressure in chamber 6*b* due to the suction produced at the venturi throat on the suction orifice 5. The water pressure transmitted to the chamber 6*b* through the orifice 11, moves the resilient diaphragm 9 and its associated rod 15 against the closure disc 12 loaded by the spring 14, thus opening the valve seat orifice 13. The gas flows from the duct 17 through the inlet 7 and orifice 13 to the gas outlet 8 and duct 20 if the cone valve 28 is in its open position, thus reducing the pressure in the lower chamber 16 of the main gas valve (V). The gas supply pressure forces the resilient diaphragm 25 against the action of the spring 27 and the combustible gas flows to the burner 19**.

The flow of gas through the duct 17 causes downward movement of the ignition retarding valve 24 to reduce the discharge rate of the lower chamber 16 thus producing a slow separation of the diaphragm 25 from the gas outlet 26 and thence the progressive lighting of the burner 19, preventing the sudden ignition of said burner. This is advantageous because there is no sooting of the burner and no detonation noise.

When the water flow through the hollow body 1 decreases for any reason, or if it ceases, the pressure in the chamber **6*a* and 6*b* of the primary valve (V) is equalized and the spring 14 forces the disc 12 against the valve seat orifice 13 interrupting the flow of gas from the lower chamber 16 of the main gas valve (GV). The pressure in the lower chamber 16 and upper chamber 22, is equalized and the spring 27 produces rapid movement of the diaphragm 25 to close the main gas outlet 26 and to interrupt the gas flow to the burner 19**.

A description of the operation of the thermostatic water temperature control of the water heater is as follows.

The sensor bulb 30 senses the water temperature in a suitable part of the heating coil (H) and the consequent increase or decrease in the volume of the liquid or gaseous medium inside the bulb 30 and capillary tube 31 controls the movement of the conical end 32 of the thermostatic bellows 33 which is attached to the bottom part of the casing of the diaphragm valve (GV). This conical end 32 moves forward or backwards relative to the perforated pin at the inner end of shaft 34 that forms part of the temperature setting knob 35 which is suitably graduated for the convenience of the user.

When the temperature setting is increased (by the clockwise turning of said knob 35) the threaded portion 36 determines the position of the perforated pin 34, and the conical end 32 of the thermostat is forced to travel further before seating on the mouth of said perforated pin 34.

As the conical end 32 moves toward the open end of said perforated pin 34 due to an increase in the temperature of the water sensor bulb 30 the gas flow from the upper chamber 22 and the lower chamber 16, through the ducts 17, 20 and the passages 7, 8, is restricted, thus producing a pressure increase in the bottom chamber 16 and forcing the diaphragm 25 upwardly to restrict the gas flow to the burner 19. This lowers the flame and causes a quick reduction of the water temperature in the heating coil (H) and the hot water outlet pipe.

The water temperature reduction is sensed by the bulb 30 and the respective reaction of the thermostatic means is to retract the conical end 32 away from the perforated pin 34, allowing a larger flow of gas through duct 17 and reducing the pressure in the bottom chamber 16 thus allowing the opening of the diaphragm due to the pressure increase in the upper chamber 22 and increasing the gas flow to the burner 19 which in turn causes the water temperature to increase until the high water temperature again causes the restriction of the gas flow to the chamber 37 and the reduction of the gas flow to the burner 19. The above mentioned cycle is repeated again and again while the water heater is in operation and the "response" (reaction time to the temperature changes) is so fast and accurate that it has been found under operating conditions the temperature of the outlet water is constant through the entire range of the system (from 30°to 60° C.).

It must be noted that even if the conical end 32 of the thermostat fully closes the outlet of the gas exhausted through the perforated pin 34 the burner is not totally turned off because a small amount of gas keeps flowing through passages 38 and 39 which by-pass the perforated pin 34, to maintain a small pressure differential between the upper chamber 22 and the bottom chamber 16 of the diaphragm valve, thus allowing a small gas flow which produces a "minimum flame" that can be easily regulated by adjusting the setting of the "minimum flame screw" 37 to decrease or increase the small flow of the gas from the upper chamber to the bottom chamber of the main gas valve.

In the preferred embodiment described, the extent of opening of valve disc 12 is a function of the pressure difference between chambers 6*a* and 6*b* of primary valve V. This pressure difference is also a function of the rate of water flow through venturi 4. Hence, at low water flow rates valve disc 12 opens only slightly, thus assisting bellows 33 and thermostat 30 to maintain a preset constant temperature of the water flowing through heater H, and further minimizing flame fluctuation of the burner. As the flow rate of the water is increased, a point is ultimately reached where the pressure difference across diaphragm 9 is sufficient to fully open valve disc 12. At flow rates above this point, control of the pressure in chamber 16, and hence, the extent of opening of the main valve seat 26 is fully under the control of thermostat 30 by virtue of its operation of conical end 32 by bellows 33. Hence, primary valve V provides the additional advantage of better main flame control at low water flow rates.

What is claimed is:

1. In combination with a main diaphragm valve for controlling the flow of gas to a water heater including a burner controlled in response to the flow of water to said heater, said main valve comprising first and second chambers separated by a diaphragm, said first chamber being provided with a gas inlet and a gas outlet leading to said burner, and said diaphragm being movable between a first position closing said gas outlet and a second position in which said gas outlet is left open in dependence on the relative pressure in said chambers, the improvement comprising:

gas duct means connecting said first and second chambers, and providing a passage for exhausting gas from said second chamber, water actuated valve means responsive to the rate of flow of water through the heater for controlling the exhaust of gas from said second chamber through said gas duct means, said water actuated valve means comprising, a venturi type restrictor in a water flow line of the heater, opposed chamber separated by a diaphragm, and means connecting the diaphragm to a control valve in said gas duct means, passage means connecting one of said chambers to a throat region of said venturi restrictor, and passage means connecting the other of said chambers to said water flow line at a location spaced from said venturi restrictor, and manually adjustable heat responsive means responsive to the temperature of the water in said heater for additionally controlling the exhaust of gas from said second chamber through said gas duct means as a function of the temperature of the water in the heater, said venturi and second diaphragm comprising means for controlling the extent of opening of said control valve as a function of the rate of flow of water through the heater throughout a range of water flow ratio through the heater, so that the extent of opening of the main valve is controlled by both said heat responsive means and said control valve throughout said range of water flow ratio through the heater.

2. A valve as claimed in claim 1, wherein said control valve includes a resilient seal element, and spring means for normally urging said seal element against a seat to close the control valve, and said means connecting the valve to the diaphragm comprises a pin extending between the diaphragm and the control valve to open the seal element against the action of the spring means in response to water flow through the venturi restrictor.

* * * * *